US011363400B2

(12) United States Patent
Wühle et al.

(10) Patent No.: US 11,363,400 B2
(45) Date of Patent: Jun. 14, 2022

(54) METHOD FOR INFLUENCING AN AUDITORY DIRECTION PERCEPTION OF A LISTENER AND ARRANGEMENT FOR IMPLEMENTING THE METHOD

(71) Applicant: TECHNISCHE UNIVERSITÄT DRESDEN, Dresden (DE)

(72) Inventors: Tom Wühle, Dresden (DE); Sebastian Merchel, Radebeul (DE); Ercan M. Altinsoy, Berlin (DE)

(73) Assignee: Technische Universität Dresden, Dresden (DE)

( * ) Notice: Subject to any disclaimer, the term of this patent is extended or adjusted under 35 U.S.C. 154(b) by 0 days.

(21) Appl. No.: 17/046,409

(22) PCT Filed: Mar. 12, 2019

(86) PCT No.: PCT/DE2019/100214
§ 371 (c)(1),
(2) Date: Oct. 9, 2020

(87) PCT Pub. No.: WO2019/196975
PCT Pub. Date: Oct. 17, 2019

(65) Prior Publication Data

US 2021/0112360 A1 Apr. 15, 2021

(30) Foreign Application Priority Data

Apr. 13, 2018 (DE) ..... 10 2018 108 852.3

(51) Int. Cl.
*H04S 7/00* (2006.01)
*H04R 3/12* (2006.01)
(Continued)

(52) U.S. Cl.
CPC ..... *H04S 7/302* (2013.01); *H04R 3/12* (2013.01); *H04R 5/02* (2013.01); *H04R 29/002* (2013.01);
(Continued)

(58) Field of Classification Search
CPC ..... H04S 7/302; H04S 7/305; H04S 2420/05; H04S 2420/01; H04R 3/12; H04R 5/02;
(Continued)

(56) References Cited

U.S. PATENT DOCUMENTS

| | | | |
|---|---|---|---|
| 9,674,609 B2 | 6/2017 | Katayama et al. | |
| 2017/0053641 A1 | 2/2017 | Kamdar et al. | |
| 2017/0070837 A1* | 3/2017 | De Poortere | H04S 7/302 |

FOREIGN PATENT DOCUMENTS

| | | |
|---|---|---|
| EP | 2 596 649 B1 | 9/2015 |
| EP | 3 142 384 A1 | 3/2017 |

OTHER PUBLICATIONS

International Search Report issued by the European Patent Office in International Application PCT/DE2019/100214, dated Jun. 17, 2019.
(Continued)

*Primary Examiner* — Andrew L Sniezek
(74) *Attorney, Agent, or Firm* — Ursula B. Day, Esq.

(57) ABSTRACT

A method for influencing an auditory direction perception of a listener, and to an arrangement for it the method is disclosed, to provide a solution, by means of which the improvement of the suppression of the auditory localization of a direction of one or more real sources $S_1$ of a sound projecting audio playback system is achieved in that a localization-masking additionally generated sound entity is provided and is radiated by the real source $S_1$ with a directional effect in a defined direction.

10 Claims, 6 Drawing Sheets

(51) Int. Cl.
*H04R 5/02* (2006.01)
*H04R 29/00* (2006.01)

(52) U.S. Cl.
CPC ..... *H04S 7/305* (2013.01); *H04R 2203/12* (2013.01); *H04R 2430/20* (2013.01); *H04S 2420/01* (2013.01); *H04S 2420/05* (2013.01)

(58) Field of Classification Search
CPC ..... H04R 29/002; H04R 2203/12; H04R 2430/20
See application file for complete search history.

(56) References Cited

OTHER PUBLICATIONS

Hagen Wierstorf et al. "Die Rolle des Präzedenzeffektes bei der Wahrnshmung von räumlichen Aliasingartefakten bei der Wellendfeldsynthese" Fortschritte der Akustik [DAGA 2010] vol. 2, Jan. 1, 2010, pp. 639-640.
Cox et al. "Practical Supergain" In: IEEE Transactions on Acoustics, Speech, and Signal Processing, vol. aasp-34, No. 3, Jun. 1986.
Gálvez et al. "A superdriective array of phase shift sources" J. Acoust. Soc. Am., vol. 132, No. 2, Aug. 2012, p. 746-756.
Wühle, T .et al.: Evaluation of auditory events with projected sound sources using perceptual attributes. In: Audio Engineering Society 142$^{nd}$ Convention, 2017.
Wühle, T.; Altinsoy, M.: Investigation of auditory events with projected sound sources. In: 173$^{rd}$ Meeting of Acoustical Society of America and 8$^{th}$ Forum Acusticum, 2017.
Klepper, D.; Steele, D.: Constant Directional Characteristics from a Line Source Array. In: Journal of the Audio Engineering Society 11 (1963), July, No. 3, pp. 198-202.
Möser, M.: Amplituden-und Phasen-gesteuerte akustische Sendezeilen mit gleichmäßiger Horizontal-Richtwirkung. In: Acustica 60 (1986), April, No. 2, pp. 91-104.
Van der Val, M.et al.: Design of Logarithmically Spaced Constant Directivity Transducer Arrays. In: Journal of the Audio Engineering Society 44 (1996), June, No. 6, pp. 497-507.
Van Beuningen, G.; Start, E.: Optimizing Directivity Properties of DSP controlled Loudspeaker Arrays. In: Reproduced Sound 16 Conference, Statford (UK), 2000.
Keele Jr., D.: The Application of Broadband Constant Beamwidth Transducer (CBT) Theory to Loudspeaker Arrays. In: Audio Engineering Society Convention 109, 2000.
Keele Jr., D.: Implementation of Straight-Line and Flat-Panel Constant Beamwidth Transducer (CBT) Loudspeaker Arrays using Signal Delays. In: Audio Engineering Society Convention 113, 2002.
Mabande, E.; Kellermann, W.: Towards Superdirective Beamforming with Loudspeaker Arrays. In: Conf. Rec. International Congress on Acoustics, 2007.
Ziemer T.: "A Psychoacoustic Approach to Wave field Synthesis", Institute of Musicology, University of Hamburg, Germany In: AES Conference 42$^{nd}$ International Conference: Semantic Audio Jul. 22, 2011.
Van der Wal, M. et al.: "Design of Logarithmically Spaced Constant-Directivity Transducer Arrays", In: Journal of the Audio Engineering Society 44 (1996), Jun., No. 6, pp. 497-507.
Gálvez et al. "A superdirective array of phase shift sources" J. Acoust. Soc. Am., vol. 132, No. 2, Aug. 2012, p. 746-756.

* cited by examiner

Prior Art

METHOD FOR INFLUENCING AN AUDITORY DIRECTION PERCEPTION OF A LISTENER AND ARRANGEMENT FOR IMPLEMENTING THE METHOD

CROSS-REFERENCES TO RELATED APPLICATIONS

This application is the U.S. National Stage of International Application No. PCT/DE2019/100214 which designated the United States and has been published as International Publication No. WO 2019/196975 A1 and which claims the priority of German Patent Application, Serial No. DE 10 2018 108 852.3 filed Apr. 13, 2018, pursuant to 35 U.S.C. 119(a)-(d) the description of which is hereby incorporated by reference.

BACKGROUND OF THE INVENTION

The invention relates to a method for influencing an auditory direction perception of a listener, wherein a focused sound is emitted by a real source $S_1$ having a directional effect, which reaches the listener in a direct way between the real source $S_1$ and the listener at a time $t_1$ as a direct sound component and after at least one reflection from a direction different from the direction of the real source $S_1$ at a time $t_0$ as a reflected sound component.

The invention also relates to an arrangement for implementing the method for influencing an auditory direction perception of a listener.

Localization masking is intended to obscure for a listener the direction of the sound of a real source of a sound-projecting audio playback system. At the same time, the perception of the direction of the listener in a direction other than the direction of the real source is to be intensified.

Sound-projecting audio playback systems are formed by one or more real sources with, for example, high directivity, which are located in a room with sound-reflecting boundary surfaces. A real source can include one or more sound transducers, such as loudspeakers. Such sound-reflecting boundary surfaces are, for example, walls, windows and doors. By emitting strongly focused sound beams through the real sources, targeted reflections at these sound reflecting boundary surfaces can be generated. So-called virtual sources are formed by one of these reflections or by a combination of several reflections.

With sound-projecting audio playback systems of this type, an auditory direction perception of, for example, sounds or instruments can be shifted away from the real source by using targeted reflections.

The achievable directivity of real sources is physically limited by their limited size and by the number of the sub-elements involved in the sound radiation. Further explanations are given, for example, in OLSON, H.: Acoustical Engineering. D. Van Nostrand Company INC., Princeton, N.J., Toronto, New York, London, 1957.

The resulting focusing power is frequency-dependent and limited to a medium frequency range.

The auditory perception of the listener is influenced not only by projected sound from the direction of one or more virtual sources, but also by the direct sound arriving directly from the direction of one or more real sources. This direct sound does not propagate along reflection paths and therefore reaches a listener earlier than the projected sound.

Depending on the frequency-dependence of the focusing power, the spectral composition and the total energy of the two sound components are different. Depending on its spectral composition and the total energy remaining, direct sound can dominate the auditory direction perception of a listener. The precedence effect then localizes for a listener, for example, a sound or an instrument in the direction of the real source(s). Alternatively, the hearing event of the listener may be broken down into components arriving from different directions. Such scenario is disclosed, for example, in Wühle, T; Merchel, S.; Altinsoy, M.: Evaluation of auditory events with projected sound sources using perceptual attributes. In: Audio Engineering Society $142^{nd}$ Convention, 2017, or Wühle, T.; Altinsoy, M.: Investigation of auditory events with projected sound sources. In: $173^{rd}$ Meeting of Acoustical Society of America and $8^{th}$ Forum Acusticum, 2017.

Real sources of sound-projecting audio playback systems are mostly formed by so-called loudspeaker arrays, in which several loudspeakers or sound converters are arranged next to one another and/or one above the other. No focusing can be achieved for frequencies smaller than a certain lower cut-off frequency, due to the ratio of the size of a loudspeaker array to the wavelength of the emitted sound. For frequencies greater than a certain upper cut-off frequency, the focusing power collapses frequently due to so-called spatial aliasing. In spatial aliasing, new main lobes form at the frequency depending on the ratio of a loudspeaker distance to the wavelength of the emitted sound, which with increasing frequency migrate towards the original main lobe.

In order to optimize the focusing properties of such loudspeaker arrays, numerous approaches have already been established in the prior art. For example, special loudspeaker arrangements and/or corresponding signal processing for optimizing the focusing performance with regard to the frequency range, achievable side-lobe attenuation and/or reduction of spatial aliasing are known.

Solutions from this state of the art can be found in KLEPPER, D.; STEELE, D.: Constant Directional Characteristics from a Line Source Array. In: Journal of the Audio Engineering Society 11 (1963), July, No. 3, pp. 198-202, MOSER, M.: Amplitude and phase controlled acoustic transmission lines with uniform horizontal directionality. In: Acustica 60 (1986), April, No. 2, pp. 91-104, VAN DER VAL, M.; START, E.; DE VRIES, D.: Design of Logarithmically Spaced Constant Directivity Transducer Arrays. In: Journal of the Audio Engineering Society 44 (1996), June, No. 6, pp. 497-507 and VAN BEUNINGEN, G.; START, E.: Optimizing Directivity Properties of DSP controlled Loudspeaker Arrays. In: Reproduced Sound 16 Conference, Statford (UK), 2000.

Further examples can be found in KEELE JR., D.: The Application of Broadband Constant Beamwidth Transducer (CBT) Theory to Loudspeaker Arrays. In: Audio Engineering Society Convention 109, 2000, or KEELE JR., D.: Implementation of Straight-Line and Flat-Panel Constant Beamwidth Transducer (CBT) Loudspeaker Arrays using Signal Delays. In: Audio Engineering Society Convention 113, 2002.

With particular mechanical arrangements of individual loudspeakers and/or additional digital processing of their control signals, a more homogeneous focusing behavior is achieved, particularly in the middle frequency range, or the effect of spatial aliasing is reduced. Such approaches are also known as "constant beamwidth" approaches.

Also known are so-called "superdirective" approaches, which enable comparatively strong focusing and expand the effective frequency range of the focusing slightly to low frequencies. A respective discussion can be found in BITZER, J.; SIMMER, K.: Superdirective Microphone Arrays. In: BRANDSTEIN, M. (ed.); WARD, D. (ed.): Microphone Arrays. Springer Verlag, 2001, pp. 19-37 and GÁLVEZ, M F S; ELLIOTT, S J; CHEER, J.: A Superdirective Array of Phase Shift Sources. In: Journal of the Acoustical Society of America 132 (2012), June, No. 2, p. 746.

In addition to the radiation of focused sound bundles, modern sound-projecting audio playback systems use filtering based on a head-related transmission function (HRTF) of sound components that are either directly or indirectly radiated via projection, in order to produce at the listener a localization deviating from the direction of the real source. The so-called head-related transfer function (HRTF) or outer ear transfer function describes a complex filter effect in which a person's head, outer ear and torso are involved.

An application of HRTF filtering is based on measurements of the directional behavior of the outer ear. This directional behavior imprints on the sound a frequency response, which the sound would have if it would arrive at the listener from a certain direction. For example, the proportion of high frequencies can be reduced to create the illusion that the sound is emitted from a position behind the listener. In this way, the perception of sound can be supported in a certain direction. Approaches of this type are known, for example, from U.S. Pat. No. 9,674,609 B2.

Conventional sound-projecting audio playback systems, where the generation of virtual sources is based solely on the use of reflections, are fundamentally limited to a medium effective frequency range due to physical restrictions. The physical dimension of the array affects the lower cut-off frequency due to a lack of ability to concentrate the sound at long wavelengths, while the mutual distance between the speakers affects the upper cut-off frequency (spatial aliasing).

Complex signal processing approaches to improve the absolute focusing performance and/or to expand the frequency range are particularly susceptible to irregularities within the individual channels, as discussed in Cox, H.; Zeskind, R.; Kooij, T: Practical Supergain. In: IEEE Transactions on Acoustics Speech and Signal Processing 34 (1986), June, No. 3, pp. 393-398 and Mabande, E.; Kellermann, W.: Towards Superdirective Beamforming with Loudspeaker Arrays. In: Conf. Rec. International Congress on Acoustics, 2007.

Even minimal fluctuations in the installation position of the loudspeakers or production-related deviations in the transmission behavior of the individual loudspeakers can often prevent the theoretical performance of such approaches from being achieved in practice. As a result, localization in the direction of the real source can only be suppressed for playback having certain spectral and temporal properties.

Spectral properties are to be understood as referring to the frequency components of a signal.

Temporal properties are to be understood as referring to a time profile of a signal, such as a sound pressure-time profile.

The underlying data for HRTF-based filtering for sound components emitted directly or indirectly via projection, as is used in complex sound-projecting audio playback systems, are mostly based on measurements on an artificial head or on averaging over a comparatively small number of measurements on test subjects. These data may differ significantly from the individual head-related transmission functions of the listener, which limits the achievable effect. If a virtual source is generated jointly by sound projection and HRTF-based filtering, the resulting mixed products can cause an incorrect localization or entirely prevent a clear localization in the superposition of the corresponding sound components.

There is therefore a need for a solution that overcomes the disadvantages of the prior art and enables improvement of the suppression of the auditory localization in the direction of one or more real sources of a sound-projecting audio playback system.

In contrast to absolute masking, this is not about making the real source inaudible, but exclusively about preventing the perception of the direction of the real source, which can also be called localization masking.

This is particularly interesting when a limited absolute focusing power and the physically limited frequency range of one or more real sources complicate or prevent sound projection using classic methods.

SUMMARY OF THE INVENTION

The object of the invention is now to provide a method for influencing an auditory direction perception of a listener and an arrangement for implementing the method, with which the suppression of the auditory localization of a direction of one or more real sources of a sound-projecting audio playback system can be improved. In this way, the perception of a listener of an auditory direction is to be shifted away from a real source.

The object is achieved by a method for influencing an auditory direction perception of a listener comprising emitting a focused sound by a real source $S_1$ having a directional effect and reaching the listener on a direct path between the real source $S_1$ and the listener at a time $t_1$ as a direct sound component and after at least one reflection from a direction that is different from the direction of the real source $S_1$ at a time $t_0$ as a reflected sound component, generating an additional localization-masking sound instance radiated by the real source $S_1$ with a directional effect in a defined direction.

The object has been achieved by and arrangement for implementing the method for influencing an auditory direction perception of a listener including a localization masking processor for generating the at least one additionally generated, localization-masking sound instance, that the localization masking processor comprises a first input for parameters L(f), Δt, ϑ, φ for each direct and each projected transmission channel, a second input for a playback signal x(t) with a desired localization direction $\vartheta_{Lok}$; $\varphi_{Lok}$, and an output for outputting control signals y(t) and their radiation direction $\vartheta_{Beam}$; $\varphi_{Beam}$, and that the output is connected to a sound projecting audio playback system. Further embodiments are also disclosed.

To suppress the auditory localization of a direction of a real source of a sound-projecting audio playback system, it is provided to generate at least one additional sound instance, which a listener perceives as at least one virtual sound source from a direction deviating from the real source. By generating this additional sound instance such that this additional sound instance arrives at the listener before the sound of the real source and by exploiting the precedence effect, the localization in the direction of the real sound source is suppressed, thus shifting the localization. This process is also referred to as localization masking and thus differs from an absolute masking. The goal with absolute masking is to make certain sound components inaudible.

To implement the method, the concrete playback situation is first characterized by measuring or calibrating the surroundings. For this purpose, the impulse responses of the direct and projected sound transmission paths can be determined in a specific and spatially limited playback area. This can be performed with a measuring system or based on geometric, acoustic or electroacoustic models of the playback room and real source.

The complex frequency responses L(f) of the transmission paths are then derived, as are the associated delay times $\Delta t$, with which the sound components from the direction of the virtual source arrive at the listener by way of at least one reflection with respect to the sound components that arrive directly from the direction of the real source. Although this description refers for sake of simplification to a real source and a virtual source, a person skilled in the art will understand that this will also apply to several real sources and several virtual sources. For example, a virtual source can be formed by a single reflection point. Alternatively, a virtual source can be formed, for example, by two or more reflection points. In one example, a virtual source can be formed intermediate on a path between two reflection points.

The complex frequency responses have a magnitude and a phase and thus enable an unambiguous characterization based on the impulse response defined in the time domain.

Based on these data, for example, a so-called localization masking processor generates additional sound instance which arrives at the listening position from the direction of a reflection, for example shifted by a defined time $\Delta t_M$.

When using a reflection path, on which the sound of the additional sound instance is reflected, for example on walls inside a room, the additional sound instance reaches the listener from a direction that is different from the radiation direction. Thus, for example, a sound event can be generated that arrives from the side or from an area behind the listener. For example, since a property and the geometry of a room is known from a calibration of the surroundings, a desired effect, such an effective sound arriving from the right rear, can be produced for the listener by emitting sound in a defined direction.

The intention is to control the radiation of the additional sound instance in the time domain. With the knowledge of the reflection path, the time control can be adjusted such that the additional sound instance arrives at the listener earlier and thus enables localization masking of the real source.

In an alternative embodiment, the localization masking processor may generate several additional sound instances which arrive at the position of the listener from different directions of the reflections, each shifted by defined time differences $\Delta t_M$. The time differences $\Delta t_M$ between the plurality of additional sound instances can here be identical or different from each other.

Compared to playback without localization masking, an absolute delay can thus be generated, which is made possible by buffering the playback signal.

In addition, one or more additional sound instances may be pre-distorted and hence have, as a result of focusing-dependent frequency-dependent amplitude attenuation, for example the same complex frequency response as the original direct sound.

According to the so-called precedence effect, which is also referred to as the "law of the first wave front", when the same sound signal arrives at a listener with a time delay from different directions, the sound signal arriving first determines the direction perceived by the listener. The direction of the sound signal arriving at the listener first is then also assigned to the sound signals arriving at the listener with a delay.

The precedence effect between the additional sound instance and the original direct sound now causes the direct sound to be localized in the direction of the virtual source. Depending on the playback signal, playback situation and structure of the real source, further manipulation of the complex frequency response and/or the localization masking level $L_M$ of the additional sound instance(s) may be necessary.

In such a manipulation of the complex frequency response, for example, subjective user settings and/or room acoustic measurements, model simulations or estimates and/or psychoacoustic measurements, model simulations or estimates and/or electroacoustic measurements, model simulations or estimates can be taken into account.

A user can, for example, select the size of the localization masking level $L_M$ or an effective frequency range according to his/her own taste.

Electroacoustic measurements, model simulations or estimates relate to predictions about the expected transmission behavior of the real source, which is to be regarded as part of the transmission path.

Room acoustic measurements, model simulations or estimates relate to predictions about the effect of the room using models or estimates. For example, a prediction of an expected transmission behavior of the room can be generated by specifying a room size, position of the real source and user, and the reflection properties of the sound-reflecting boundaries such as walls, as well as an absorption level or a scattering behavior. This knowledge can be used to determine an optimal complex frequency response or an optimum localization masking level $L_M$.

Psychoacoustic measurements, model simulations or estimates relate to predictions in relation to a human localization in response to known ear signals. If, for example, the signals on a user's ears are known through measurements, use of models of the behavior of the real source and/or space or the like, a prediction can be generated as to whether a desired location can be reached or not. In this way, the effects of different manipulations can also be tested and an optimum determined in this way, for example. Measurements are understood here as perception experiments or listening tests with which the localization or localization-determining threshold are examined under the influence of defined ear signals.

The localization masking level $L_M$ or the amplitude of an additional sound instance can be smaller than, equal to or greater than the level L of the associated real source. For example, the first location masking level $L_{M1}$ may be smaller than, equal to, or greater than the first level $L_1$ of the real source.

Projected sound transmission paths are used to emit an additional sound instance from the direction of the reflections.

In accordance with the aforedescribed physical relationships, this radiation generates an associated additional direct sound, which can determine the localization in the same way as the original direct sound. This is the case when the additional direct sound still exceeds a location-determining auditory perceptibility threshold. In this case, the additional direct sound can be localized by newly generating a corresponding further additional sound instance from the direction of a reflection. If the resulting further additional direct sound continues to determine the auditory direction perception of the listener, the procedure can be further continued in the same way.

As a result, n localization masking levels (with $L_{Mn}$ and $\Delta t_{Mn}$) are cascaded until earliest additional direct sound arriving at the listener no longer exceeds the localization-determining auditory perceptibility threshold, thus making a localization in the direction of the real source impossible. In a special case of this type of cascading, all additional sound instances are preceding in time.

The localization-determining influence of direct sound can be assessed, for example, based on so-called psychoacoustic models.

Depending on the temporal and spectral characteristics of the for example several additional sound instances, the temporal and spectral characteristics of the sound of the virtual source $S_0$ 10 can be additionally manipulated. For example, this can optionally be performed using envelope manipulation or HRTF filtering.

BRIEF DESCRIPTION OF THE DRAWINGS

The aforedescribed features and advantages of the present invention can be better understood and evaluated after careful study of the following detailed description of the preferred, non-limiting exemplary embodiments of the invention in conjunction with the accompanying drawings, which show in.

DETAILED DESCRIPTION OF PREFERRED EMBODIMENTS

Figure 1:
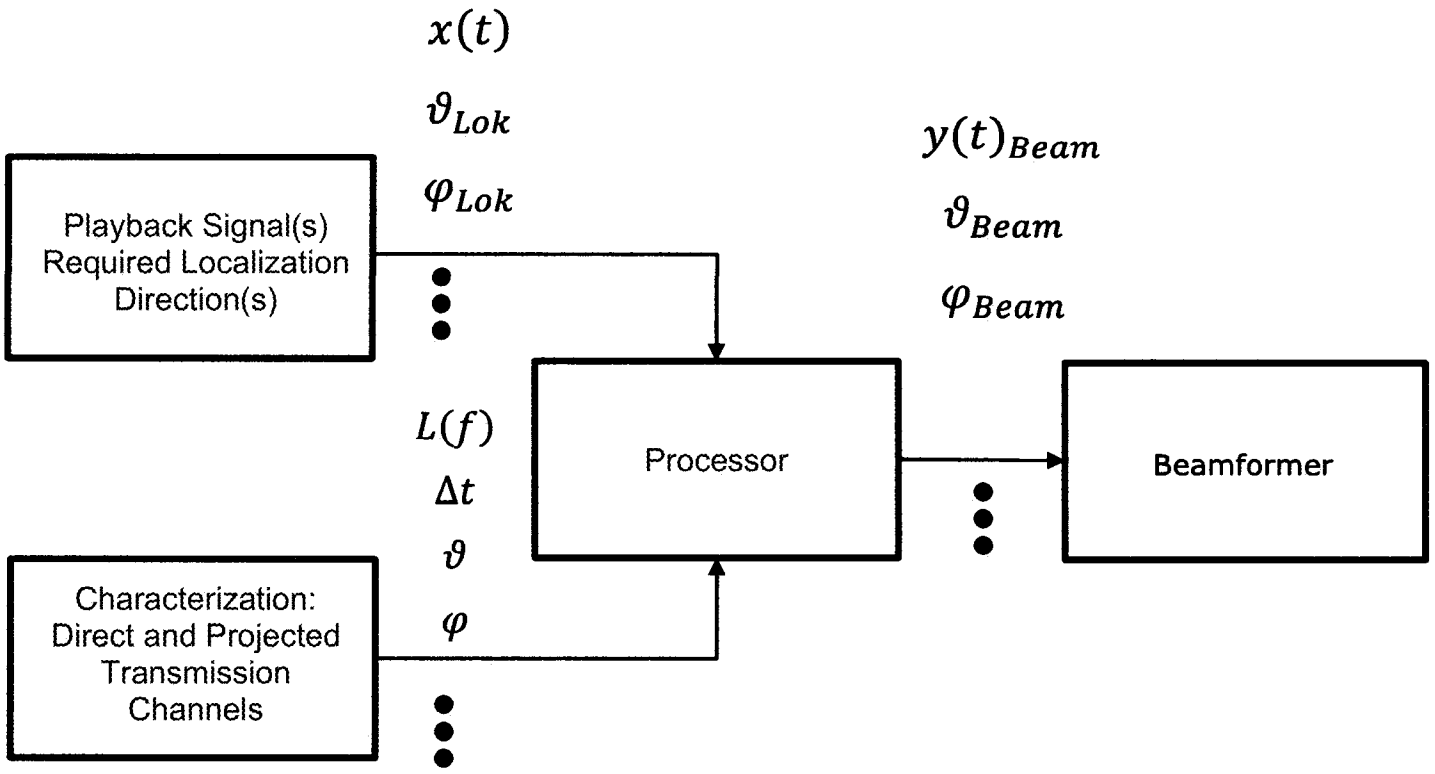
FIG. 1 a schematic diagram of the method for localization masking of a real source in a sound-projecting audio playback system.

FIG. 1 shows a schematic diagram of the method for localization masking of a real source in a sound-projecting audio playback system. FIG. 1 also shows the assemblies essential for an arrangement for implementing the method for influencing an auditory direction perception of a listener (7). In particular, a localization masking processor for generating the at least one additionally generated sound instance (13) for localization masking is illustrated. The localization masking processor, referred to in FIG. 1 for short as a processor, is connected with its output to an input of a sound-projecting audio playback system having at least one real source (1) with high directivity. This at least one real source (1) is arranged in a room (6), not shown in FIG. 1, which has sound-reflecting boundaries (11) like walls.

After a characterization or calibration of the playback situation in a specific area, such as a room 6, in which the sound-projecting audio playback system is arranged, the parameters L(f); Δt; ϑ; φ were determined for each of the direct and projected transmission channels. Here, a direct transmission channel refers to a path 8 of a direct sound from the real source $S_1$ 1 and a projected transmission channel refers to a path 9 of an indirect sound from the virtual source $S_0$ 10. Here, L(f) indicates the complex frequency response, Δt the delay time, ϑ and φ the elevation and azimuth angles in the spherical coordinate system, which is used to describe a transmission direction of the respective sound bundle of the real source into the room.

Subsequently, the localization-determining influence of direct sound is determined in a processor, such as a localization masking processor, for each playback signal x(t) having the desired localization direction $\vartheta_{Lok}$; $\varphi_{Lok}$, and based thereon the number and properties of the sound bundles or beams with corresponding additionally generated sound instances 13, 13*a*, 13*b*, . . . , 13*n* required for playback with localization masking. Thereafter, the required control signal y(t) and the required radiation direction $\vartheta_{Beam}$; $\varphi_{Beam}$ are calculated for each sound bundle and forwarded to the sound projecting audio playback system for playback.

Such a localization masking processor refers to an arrangement suitable for data processing, which can be controlled with the present method for influencing an auditory direction perception of a listener. Such control is advantageously performed with a program that implements the method for influencing an auditory direction perception of a listener.

It is envisioned that the localization masking processor has an input for parameters L(f), Δt, ϑ, φ for each direct and each projected transmission channel. In addition, the localization masking processor has a second input for a playback signal x(t) with a desired localization direction $\vartheta_{Lok}$; $\varphi_{Lok}$.

The localization masking processor also has an output for outputting control signals y(t) and their radiation direction $\vartheta_{Beam}$; $\varphi_{Beam}$ for each sound bundle. This output is connected to the real source (1) of the sound-projecting audio playback system for controlling this real source (1), such as an array of loudspeakers.

Figure 2:
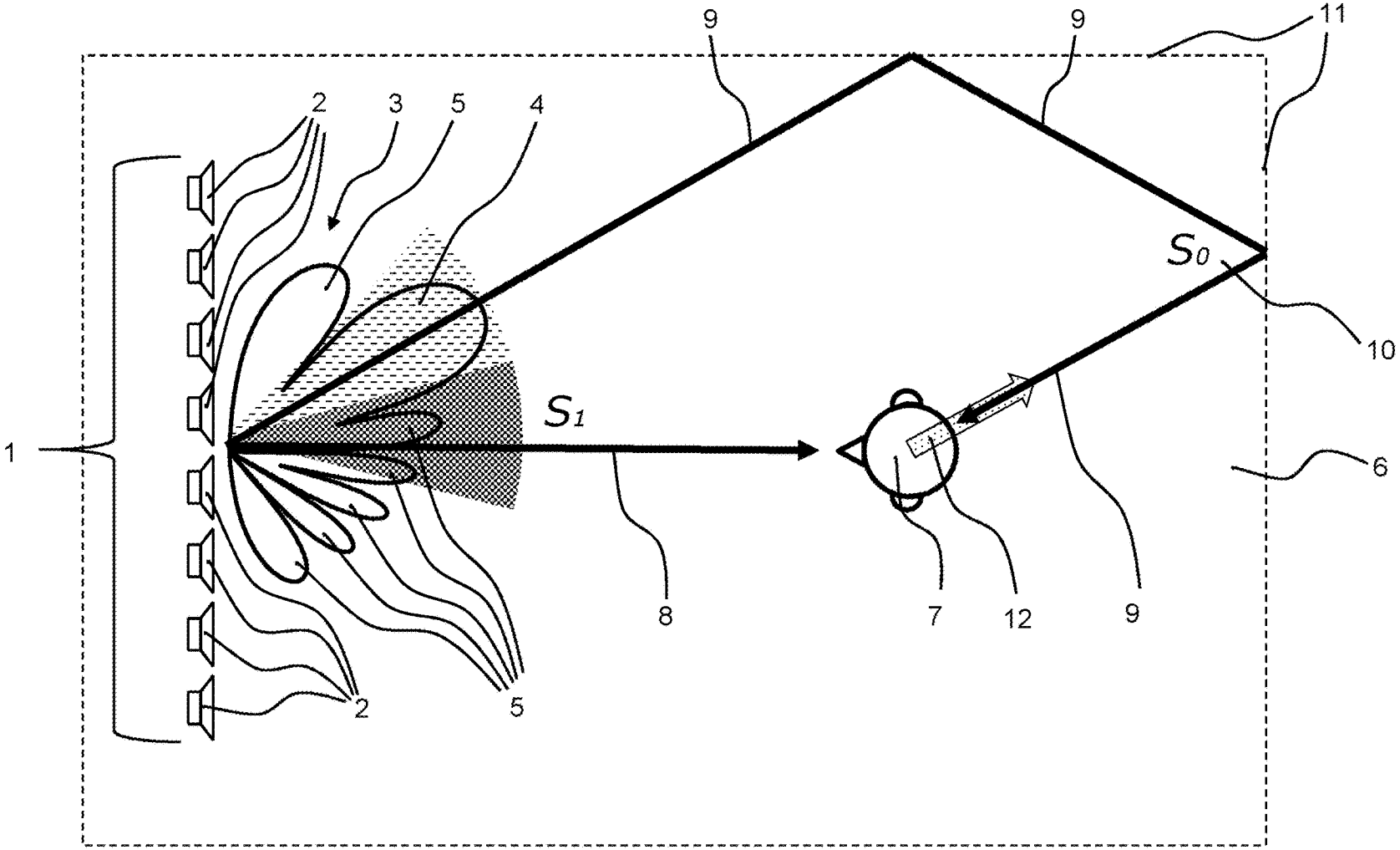
Fig. 2 Prior Art
FIG. 2: a diagram of a schematic approach for generating a virtual source according to the prior art.

FIG. 2 shows a diagram of a schematic approach for generating a virtual source according to the prior art.

FIG. 2 shows a real source $S_1$ 1 of a sound-projecting audio playback system, which in the example consists of eight loudspeakers 2, which, as illustrated, can be arranged in a single row or a single column or an array with several rows and columns. The sound generated by this real source $S_1$ 1 propagates into the room 6, for example, with the depicted radiation pattern 3. The radiation pattern 3, which is also referred to as a directional diagram, has a main emission direction with a main lobe 4 and a plurality of side lobes 5.

The real source $S_1$ 1 is arranged in a space 6 shown by a dash-dash line. A receiver 7 is arranged in this room, for example at the indicated position.

According to this schematic approach, a virtual source $S_0$ 10 is generated with the aid of reflections on the walls 11 of the room 6 and by a projection of the sound which is emitted by the real source $S_1$ 1 in the direction of the main lobe 4. In the illustrated example, this sound reaches the listener 7 after two reflections on the walls 11. The path of the reflected sound 9 causes a virtual source $S_0$ 10 to be generated, which the listener perceives in the example from the right rear.

In the example, the direct sound from the real source $S_1$ 1 reaches the listener via path 8. This sound, which is emitted directly from the direction of the real source $S_1$ 1 originates from an area with focus-related amplitude attenuation in the area of the side lobes 5. Since this sound has at most the intensity of a side lobe 5 of the radiation pattern 3 and is thus perceived by the listener 7 weaker than the sound via the path 9, a resulting hearing event direction 12 is produced for the listener 7 in the direction of the virtual source $S_0$ 10.

The illustrated exemplary radiation pattern 3 of the real source $S_1$ 1 is valid for a medium frequency range. As stated above, the resulting hearing event direction 12 of the listener 7 shown in FIG. 2 in the lower and upper frequency range cannot be successfully achieved or no longer achieved.

Figure 3:
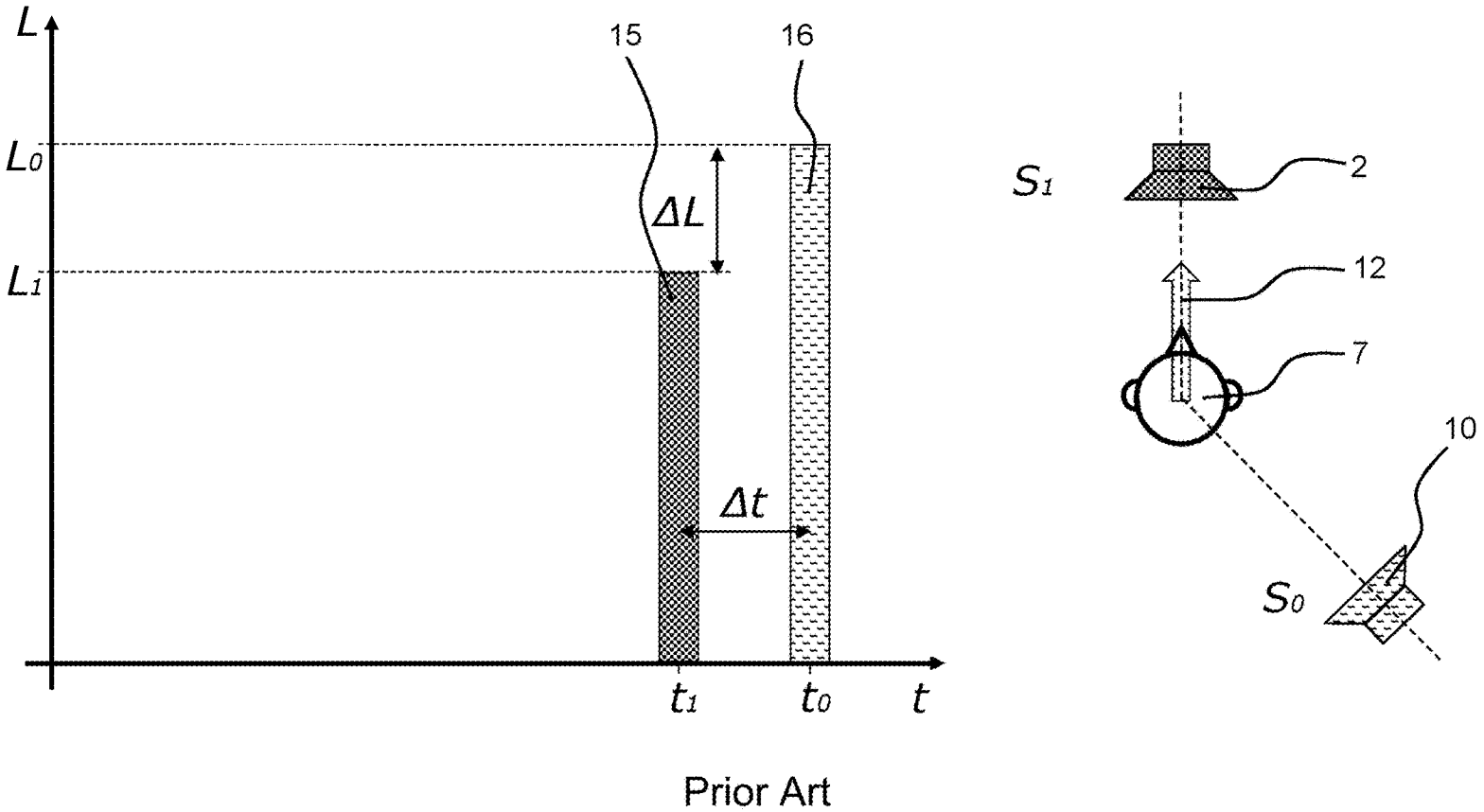
FIG. 3: an illustration of a time-amplitude diagram for a scenario according to FIG. 2, FIG. 4: a time-amplitude diagram with an additionally generated sound instance according to the invention in an idealized representation.

FIG. 3 shows on the left-hand side of the figure a schematic time-amplitude diagram of the sound arriving at the listening position of a listener 7 from the direction of the virtual source $S_0$ 10 and directly from the direction of the real source $S_1$ 1. On the right-hand side of FIG. 3, the resulting hearing event direction 12 is shown with an exemplary arranged real source $S_1$ 1 and a virtual source $S_0$ 10. The visualization of real source $S_1$ 1 and virtual source $S_0$ 10 with the aid of loudspeaker symbols serves to simplify the explanation and is not a limitation.

As can be seen, the sound from the real source $S_1$ 1 arrives at the listener 7 via the path 8 of direct sound, not shown in FIG. 3, as a direct sound component 15, for example at time $t_1$ and an exemplary level $L_1$ or amplitude. The illustrated level $L_1$ or amplitude could be, for example, a sound pressure level in dB [SPL] (SPL: Sound Pressure Level) or a sound pressure measured in Pa.

The sound of the virtual source $S_0$ 10, which arrives at the listener 7 via the path 9 of the reflected sound, which is not shown in FIG. 3, arrives at the listener for example at time $t_0$. This time $t_0$ is delayed with respect to the arrival of the direct sound from the real source $S_1$ 1 by a time difference $\Delta t$. The reason for this time delay $\Delta t$ lies in the longer path 9 of the reflected sound compared to path 8 of the direct sound, as shown in FIG. 2.

The sound of the virtual source $S_0$ 10 has a level $L_0$ or an amplitude which is greater by the difference $\Delta L$. The reason for this greater level $L_0$ or amplitude is the directivity or radiation pattern 3, with which the sound of the virtual source $S_0$ 10 propagating via the path 9 to the listener 7 is radiated in the area of the main lobe 5 of the real source $S_1$ 1.

In this example, a resulting hearing event direction 12 in the direction of the real source $S_1$ 1 arises, as shown on the right-hand side of FIG. 3. The reason for such a perception by the listener 7 is that according to the precedence effect, the sound arriving first at the listener 7 dominates the auditory direction perception.

Figure 4:
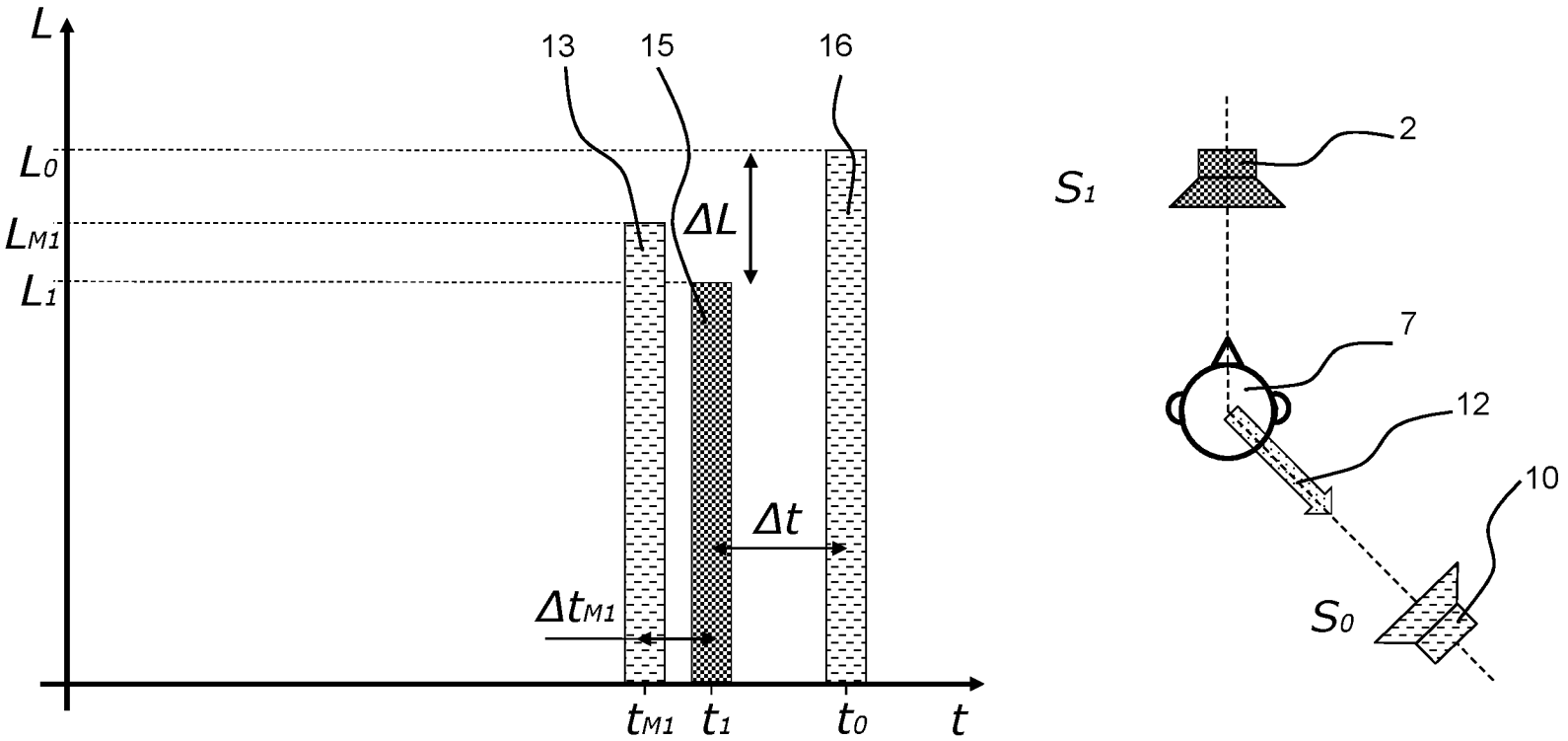

FIG. 4 shows a time-amplitude diagram with an additionally generated sound instance 13 according to the invention in an idealized diagram. The left-hand side of FIG. 4 shows again a schematic time-amplitude diagram of the reflected sound component 16 arriving from the direction of the virtual source $S_0$ 10 and of the direct sound component 15 arriving from the direction of the real source $S_1$ 1 directly at the listening position of a listener 7. The right-hand side of FIG. 4 shows the resulting hearing event direction 12 with an exemplary arranged real source $S_1$ 1 and a virtual source $S_0$ 10.

As can be seen, the additionally generated sound instance 13 is provided in such a way that it arrives at the listener 7 earlier than the direct sound component 15 of the real source $S_1$ 1 by a time difference of $\Delta t_{M1}$.

In a particular embodiment, the additionally generated sound instance 13 can be provided in such a way that it arrives at the listener 7 at the same time as the direct sound component 15 of the real source $S_1$ 1. In this case, too, localization masking is possible by designing the additionally generated sound instance 13 so that signal features of the direct sound component 15 are augmented so as to make localization in its direction more difficult or prevent it altogether. This can for example prevent transients by way of additional signal components, or can ambiguate localization by phase smearing.

In a further particular embodiment, the additionally generated sound instance 13 may be provided in such a way that it arrives at the listener 7 with a time delay, i.e. later than the direct sound component 15 of the real source $S_1$ 1.

The localization masking level $L_{M1}$ or the amplitude of the additionally generated sound instance 13 can, as shown in FIG. 4, be smaller than the level or the amplitude of the virtual source $S_0$ 10. The localization masking level $L_{M1}$ or the amplitude of the additionally generated sound instance 13 can be smaller than, equal to or greater than the level $L_1$ of the real source $S_1$ 1.

Localization masking of the direct sound component 15 of the real source $S_1$ 1 is achieved by ideally adding an additionally generated sound instance 13. This generates a resulting hearing event direction 12 in the direction of the virtual source $S_0$ 10, as shown on the right-hand side of FIG. 4.

Figure 5:
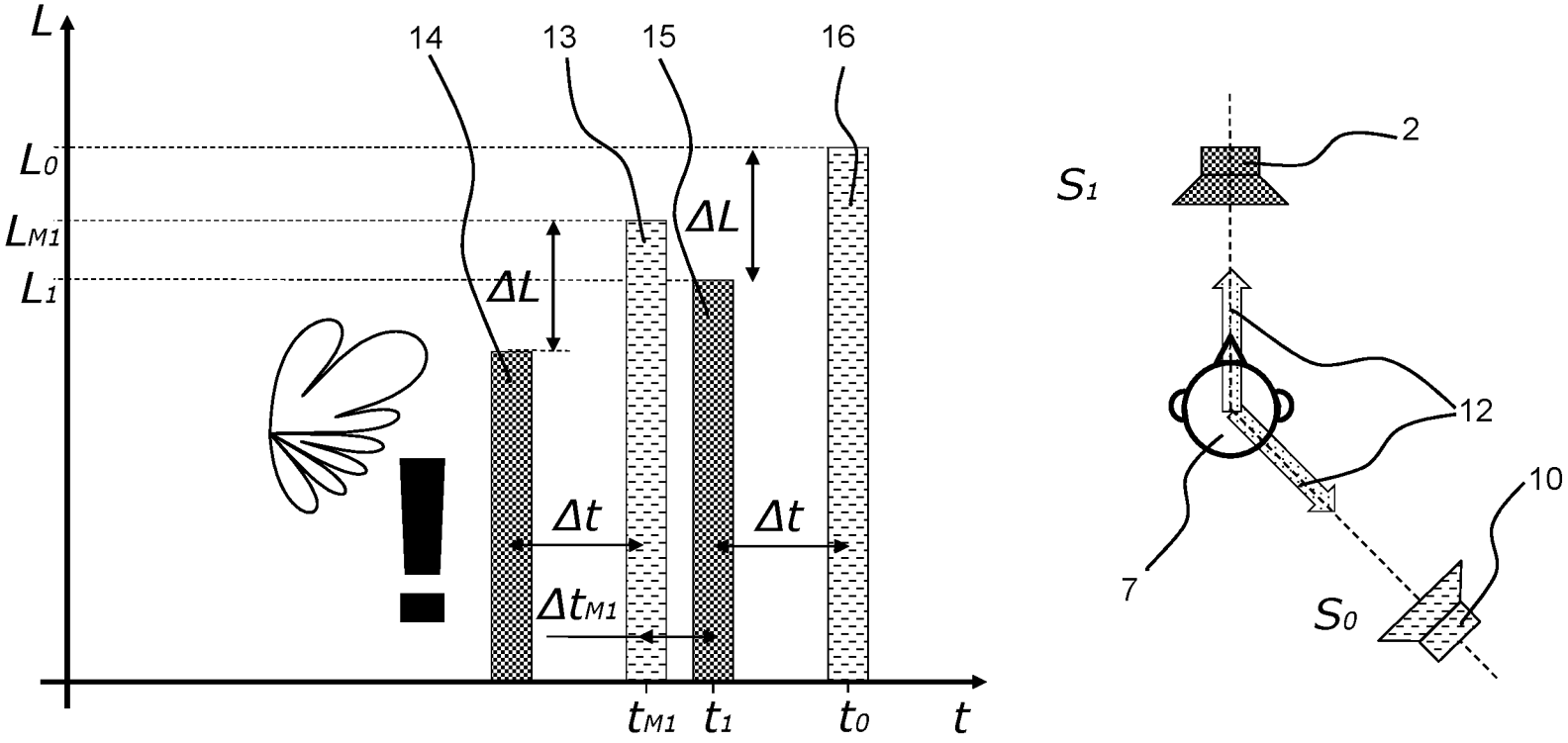
FIG. 5: in a non-idealized representation, a time-amplitude diagram with a sound instance additionally generated according to the invention.

FIG. 5 shows a time-amplitude diagram with an additionally generated sound instance 13 according to the invention in a non-idealized representation. The left-hand side of FIG. 5 shows the components of the reflected sound component 16 of the virtual source $S_0$ 10 arriving at the listener 7, as already known from FIG. 4, and the direct sound component 15 of the real source $S_1$ 1 as well as the additionally generated sound instance 13 in an idealized representation.

Due to the imperfect focusing power of the real sources $S_1$ 1, caused by the non-ideal radiation pattern 3, an additional direct sound component 14 arises in the region of the side lobes 5, which reaches the listener 7 from the direction of the real source $S_1$ 1. This undesired additional direct sound component 14 transmitted directly to the listener 7 via the path 8 is shown in the left-hand side of FIG. 5. This additional direct sound component 14 arrives at the listener 7, for example, with a lower level or a smaller amplitude that is smaller by $\Delta L$ compared to the additionally generated sound instance 13. This additional direct sound component 14 arrives, for example, earlier than the additionally generated sound instance 13 with a time difference of $\Delta t$.

The resulting hearing event direction 12 can be sufficiently influenced in this way for certain applications. There is an undesirable influence on the resulting hearing event direction 12 if the level or the amplitude of the undesired additional direct sound component 14 reaches or exceeds a localization-determining auditory perceptibility threshold for the listener 7. As shown in the right-hand side of FIG. 5, the resulting hearing event direction 12 can be influenced by two components. The first desired component influences the perception of the listener 7 in the direction of the virtual source $S_0$ 10, while the second undesired component influences the perception of the listener 7 in the direction of the real source $S_1$ 1.

This drawback of the undesired additional direct sound component 14, which undesirably influences the perception of the listener 7 in the direction of the real source $S_1$ 1, is eliminated by a further measure according to the invention.

Figure 6:
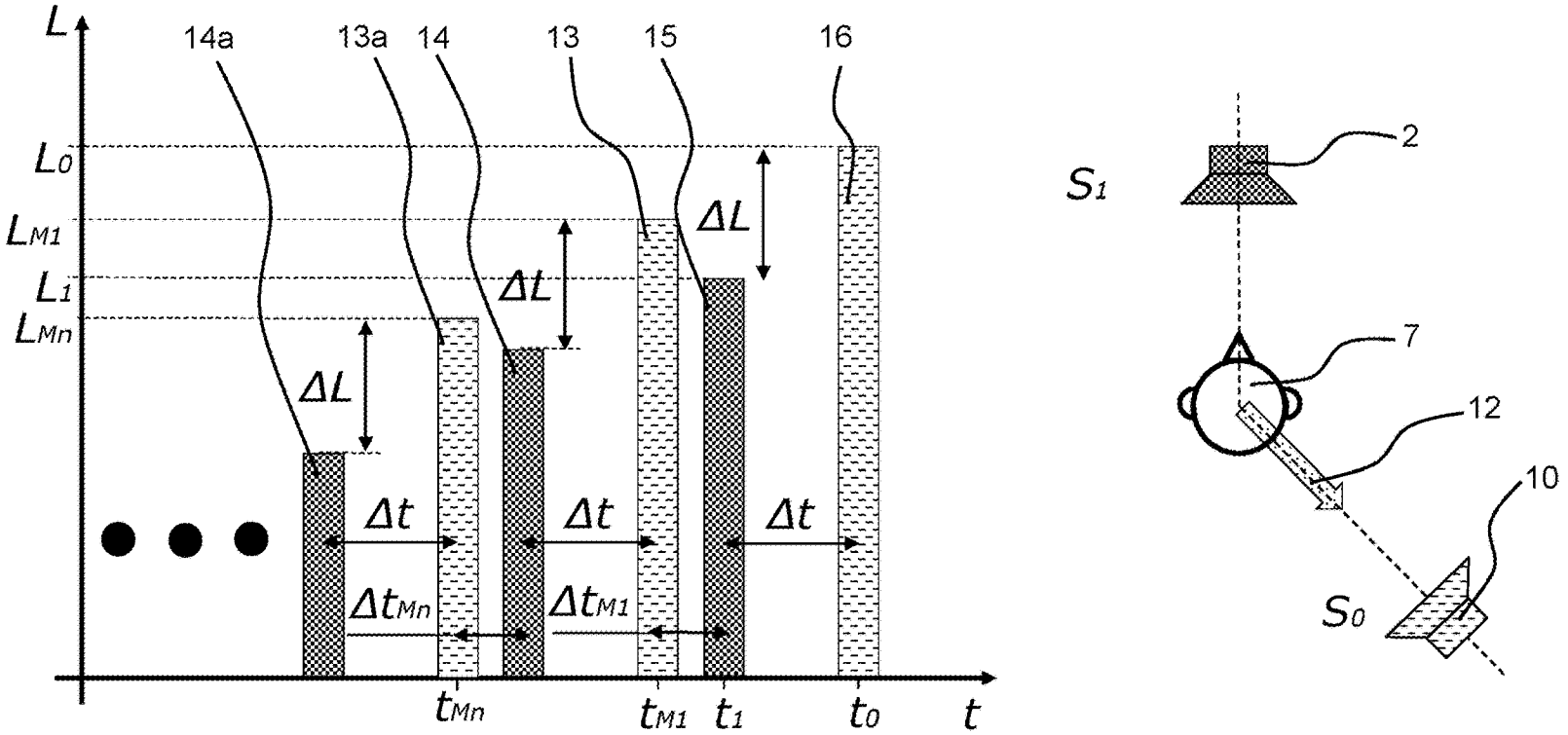
FIG. 6: a further schematic diagram of the invention with several additionally generated sound instances.

For this purpose, the additional direct sound component 14 is localization-masked by newly providing a corresponding further additionally generated sound instance 13*a*, which impinges on the listener 7 from the direction of the virtual source $S_0$ 10. This provision of a further additionally generated sound instance 13*a* is shown in FIG. 6.

The further additionally generated sound instance 13*a* is provided such that it arrives with a time difference $\Delta t_{Mn}$ before the additional direct sound component 14 in order to localization-mask the additional direct sound component 14. In the example in FIG. 6, the additionally generated sound instance 13*a* has a level or the amplitude $L_{Mn}$, which may be greater than the level or the amplitude of the additional direct sound component 14.

If the further additional direct sound component 14*a* generated by the further additional sound instance 13*a*, which reaches the listener 7 from the direction of the real source $S_1$ 1, still determines the auditory direction perception of the listener 7, the process can be further continued in the same way. Additionally generated, temporally preceding sound instances 13, 13*a*, 13*b*, . . . , 13*n* are cascaded until the listener 7 experiences a resultant hearing event 12 from the direction of the virtual source $S_0$ 10. This situation created by the method is shown in the right-hand side of FIG. 6.

This situation is achieved when, after cascading n localization masking levels (with $L_{Mn}$ and $\Delta t_{Mn}$), the additional direct sound component 14*n* arriving first at the listener 7 does no longer exceed the auditory perceptibility threshold of the listener 7 that determines the localization, thereby eliminating localization in the direction the real source $S_1$ 1. The example of FIG. 6 shows this cascading of n localization masking stages wherein all additionally generated sound instances 13, 13*a*, 13*b*, . . . , 13*n* temporally precede one another.

Even if the signal of the additionally generated sound instance 13 shown in FIGS. 3 to 6 is separated in time from the direct sound component 15 of the real source $S_1$ 1, the signals of the additionally generated sound instance 13 and the direct sound component 15 or the additionally generated sound instance 13 and the reflected sound component 16 may at least partially overlap in time. Localization masking can be achieved even with such an overlap. The temporal relationships mentioned in the present description apply in this situation, for example, between the respective starting times or times of maximum cross-correlation between the additionally generated sound instance 13 and the direct sound component 15.

What is claimed is:

1. A method for influencing an auditory direction perception of a listener comprising the steps of:

emitting a focused sound bundle by a real source $S_1$ having a steerable sound radiation pattern with a main lobe and side lobes that generates a directional effect, with sound from at least one of the side lobes reaching the listener as a direct sound component on a direct path between the real source $S_1$ and the listener and with sound from the main lobe reaching the listener as an indirect sound component on an indirect path after at least one reflection at a sound-reflecting boundary surface from a direction that is different from the direct path, wherein emitting the sound bundle comprises generating a first sound instance of the sound bundle which arrives at the listener on the indirect path later than on the direct path, generating a second sound instance of the sound bundle which arrives at the listener on the indirect path no later than the first sound instance on the direct path and has a sound amplitude equal to or greater than a sound amplitude of both the first and the second sound instance on the direct path.

2. The method according to claim 1, further comprising generating at least one additional sound instance of the sound bundle which arrives at the listener on the indirect path no later than a preceding sound instance on the direct path and has a sound amplitude equal to or greater than a sound amplitude of both the preceding and the additional sound instance on the direct path, and repeating generating additional sound instances until the listener no longer experiences a resultant hearing event from the direction of the direct path.

3. The method according to claim 2, further comprising specifying a point in time for providing the second or the at least one additional sound instance depending on at least one of subjective user settings, room acoustics measurements, model simulations and estimates.

4. The method according to claim 2, further comprising specifying a point in time for providing the second or the at least one additional sound instance depending on psychoacoustic measurements or on electroacoustic measurements.

5. The method according to claim 2, wherein the second or the at least one additional sound instance is provided using envelope manipulation or HRTF (head-related transfer function) filtering.

6. The method according to claim 5, wherein the second or the at least one additional sound instance is provided so as to at least partially overlap in time with the first sound instance or the second sound instance or the at least one additional sound instance on the direct path.

7. The method according to claim to 1, wherein the second sound instance is provided using envelope manipulation or HRTF (head-related transfer function) filtering.

8. The method according to claim 7, wherein the second sound instance is provided so as to at least partially overlap in time with the first sound instance on the direct path.

9. The method according to claim 1, wherein the real source $S_1$ has a plurality of sound transducers such as speakers, which are arranged side by side or one above the other or in an array side by side and one above the other.

10. The method according to claim 1, wherein the real source $S_1$ is arranged in a room with sound-reflecting boundaries.

* * * * *